US009682389B2

(12) United States Patent
Lee

(10) Patent No.: US 9,682,389 B2
(45) Date of Patent: Jun. 20, 2017

(54) AUTOMOTIVE, ELECTRIC WINDOW SERVICING APPARATUS AND KIT, AND METHOD FOR USING SAME

(71) Applicant: Yong Lee, San Antonio, TX (US)

(72) Inventor: Yong Lee, San Antonio, TX (US)

( * ) Notice: Subject to any disclaimer, the term of this patent is extended or adjusted under 35 U.S.C. 154(b) by 105 days.

(21) Appl. No.: 14/585,045

(22) Filed: Dec. 29, 2014

(65) Prior Publication Data

US 2016/0186477 A1 Jun. 30, 2016

(51) Int. Cl.

| | |
|---|---|
| ***B05B 9/01*** | (2006.01) |
| ***E05F 15/60*** | (2015.01) |
| ***B21D 22/04*** | (2006.01) |
| ***E05F 15/689*** | (2015.01) |

(52) U.S. Cl.

CPC ..... *B05B 9/01* (2013.01); *E05F 15/689* (2015.01); *E05Y 2800/692* (2013.01); *E05Y 2800/70* (2013.01); *E05Y 2800/744* (2013.01)

(58) Field of Classification Search

CPC ..... B05B 9/01; B21D 22/04; E05Y 2800/744; E05Y 2800/746; E05Y 2800/70; E05Y 2800/692; B25B 27/18; B25B 13/48; B25F 1/00

See application file for complete search history.

(56) References Cited

U.S. PATENT DOCUMENTS

| | | | | | |
|---|---|---|---|---|---|
| 916,620 | A * | 3/1909 | Shaul | B25F 1/00 | 7/142 |
| 2,373,901 | A * | 4/1945 | Lowery | B21D 22/04 | 72/335 |
| 3,907,452 | A * | 9/1975 | Tripp | B23B 47/281 | 408/111 |
| 3,934,677 | A * | 1/1976 | Schott | B62J 31/00 | 184/15.1 |
| 4,100,637 | A * | 7/1978 | Grieser, Sr. | B25F 1/00 | 279/147 |
| 4,445,264 | A * | 5/1984 | Banerian | B21D 22/04 | 29/445 |
| 4,815,637 | A * | 3/1989 | Nellis | B62J 31/00 | 184/15.1 |
| 4,850,758 | A * | 7/1989 | Morgan | B23B 31/005 | 279/128 |
| 5,058,783 | A * | 10/1991 | Antonelli | B65D 83/75 | 222/530 |
| 5,269,614 | A * | 12/1993 | Taylor | B62J 31/00 | 184/15.1 |

(Continued)

*Primary Examiner* — David B Thomas
(74) *Attorney, Agent, or Firm* — Jackson Walker LLP

(57) ABSTRACT

The present invention is a preventive maintenance system and kit that can prolong the life of the regulators and motors. In performing repairs to automobile power window regulators and motors, it is often the case that the repair is required due to a breakdown of the lubricant. This breakdown can be due to several factors, such as age, temperature, dirt, and salts. The window regulators and motors, without appropriate lubrication, will fail and lead to more costly repairs. A kit has been developed to service the electric windows of an automobile without disassembling the door is presented. The kit provides for access to the door interior and for lubricating the interior parts. The kit and method is designed to lubricate the many window parts in order to extend their life and maintain functionality.

23 Claims, 16 Drawing Sheets

(56) References Cited

U.S. PATENT DOCUMENTS

| | | | | |
|---|---|---|---|---|
| 6,061,940 | A * | 5/2000 | Rice | G09F 7/00 206/575 |
| 6,205,602 | B1 * | 3/2001 | Dettweiler | B25C 1/02 227/147 |
| 6,880,252 | B1 * | 4/2005 | Drake | B25C 1/02 30/366 |
| 7,040,034 | B2 * | 5/2006 | Nielson | B25H 7/00 33/574 |
| 8,387,226 | B2 * | 3/2013 | Weigel, Jr. | B21J 15/50 29/402.01 |
| 8,443,508 | B2 * | 5/2013 | Vogel | B25B 13/5091 279/144 |
| 2004/0093752 | A1 * | 5/2004 | Trice | B23B 47/287 33/574 |
| 2004/0154171 | A1 * | 8/2004 | Utz | B25D 5/02 30/367 |
| 2009/0223745 | A1 * | 9/2009 | Marcucci | B62J 31/00 184/15.2 |
| 2012/0024117 | A1 * | 2/2012 | Kreutzer | B25B 19/00 81/463 |
| 2013/0004263 | A1 * | 1/2013 | Palmisano | B21J 15/50 411/501 |

* cited by examiner

AUTOMOTIVE, ELECTRIC WINDOW SERVICING APPARATUS AND KIT, AND METHOD FOR USING SAME

This application is based upon and claims priority from U.S. Provisional application Ser. No. 61/920,876, which is incorporated herein by reference.

BACKGROUND OF THE INVENTION

Field of the Invention

Applicants' invention relates to tools and a kit for servicing electric, automotive windows and the method for using same. More particularly, it relates to the tools required to service the electric windows of an automobile without disassembling the door.

Background Information

Conventional automotive electric windows are systems designed to raise and lower the automobile's windows. Typically, there is an electric window for each automobile door with an associated switch. Often, the driver's door has a set of switches that allow the driver to operate all of the automatic windows. Power windows are usually inoperable when the car is not running. Generally, this is a security feature rather than a feature of necessity. The car battery could be put in direct communication with the windows to allow operation when the car is not running, however it is not desirable to make it easy to open the windows when the operator is not in the vehicle.

The vehicle windows that are raised and lowered are typically in the doors. Thus, it is generally a requirement that the raising and lowering mechanisms reside in the doors as well. In a traditional power window the window lifting mechanism consists of a linkage designed to lift the window while at the same time keeping the window level. A small electric motor is attached to a worm gear and several other spur gears which create gear reduction sufficient to generate enough torque to lift the window. The linkage has a long arm that attaches to a bar connected to the bottom of the window. The end of the linkage arm can slide along the length of the bar in a groove or track. The electric motor is in electronic communication with the worm gear. Activating the electric motor causes the worm gear to turn. Reversing the current flow causes the electric motor to turn in opposite directions. The worm gear is in mechanical communication, or meshed, with the spur gears. When the worm gear turns, the spur gears turn in conjunction with the worm gear. The linkage has a first end that is generally fan shaped. At the end of the fan shaped our teeth that are in mechanical communication, or meshed, with the last spur gear. Thus, the linkage is ultimately in mechanical communication with the worm gear and moves when the electric motor is activated. The linkage is rotatable about a pin that is attached to the linkage in the middle portion—not necessarily the center—of the linkage. When the spur gears turn, the spur gear teeth engage and disengage with successive linkage teeth causing the first end of the linkage to move down or up depending upon the direction of rotation of the spur gear. As the first end of the linkage moves, the linkage rotates about the pin and the linkage arm end moves in opposition to the first end. Because the linkage arm end is disposed in the window bar groove, the movement up or down of the linkage arm end causes the end to slide along the groove and the window to raise or lower.

There are other systems for raising and lowering the window automatically. Many cars today use cable driven systems.

When the window goes up or down, the drive motor and regulator must work in sync at all times. If at any time either moves out of sync (faster or slower) with the other, then the cables of the slower part begin to snag and tangle. Often, users will hear squeaking and/or the window making other noises.

Over time the mechanisms that raise and lower the window can become stuck or harder to move. Problems may also be caused by regulator failure due in part to a variety of factors such as rain, snow, rapid seasonal changes, and exposure to dust, moisture, wind, or salts. This can cause the electric motor to be unable to raise and lower the window or for the movement of the window to be slowed. Sometimes this is due to a worn out motor or two mechanical failure of the parts such as a broken cable or a part that has gotten off track. However, often it can be due to the surfaces of the moving parts in the door becoming more sticky or having increased coefficients of friction.

It is often the case that when the window starts to move up or down slower than normally, users will continue to attempt to activate the window to go up or down. By doing so, the parts start to worsen. Often, by the time the user realizes the real problem, the problem has been magnified to the extent that instead of repair the parts must be replaced.

If however the user attempts to the issue before the parts are damaged, then often the repair simply requires lubrication of the parts. However, because the parts are located within the door the repair is made much more difficult due to the requirement of removing the door panel to access the interior of the door. Being able to lubricate the interior parts of the automatic window without removing the door panel would make the repair much easier.

Thus, there is a need for a system for lubricating interior window parts, further, it is advantageous for this to be done without removing the door panel.

SUMMARY OF THE INVENTION

The present invention provides a kit with component parts to allow a user to service and lubricate parts of the automatic window opener that are inside the door frame without removing the door panel. It also includes the method of using the present invention—servicing the electric window without removing the door panel. In order to solve the difficulties presented in attempting to obtain these features, an apparatus and kit have been developed which provide for access to the door interior and for lubricating the interior parts. The kit and method is designed to lubricate the many window parts in order to extend their life and maintain functionality.

In performing repairs to automobile power window regulators and motors, it is often the case that the repair is required due to a breakdown of the lubricant. This breakdown can be due to several factors, such as age, temperature, dirt, and salts. The window regulators and motors, without appropriate lubrication, will fail and lead to more costly repairs. The present invention is a preventive maintenance system and kit that can prolong the life of the regulators and motors.

In the automobile door, there are several components and parts that must be maintained in order to extend the life of the original equipment manufacturer ("OEM") parts. These parts include:

glass regulator/motor;
door/body/skin;
hinge;
guide rails;

open handle;
lock actuators;
lock cylinders;
glass run channel;
molding;
lock latches;
sliding track cables; and
plastic pulleys and rails.

The above parts are generally made from metal, plastic, rubber, vinyl, or leather. Specific cars may also have the following:

2-8 separate regulators;
15 hinges;
2-6 latches;
8 handles;
4-6 shocks;
2-6 lock cylinders;
2-6 glass run channels; and
2-7 lock actuators.

All of the aforementioned parts need lubrication in order to extend the life of the park. Lubricating the parts will prevent rust and reduce friction, which is required for eliminating sticking, binding, and squeaking. The current invention kit helps lubricate these parts without the requirement to remove the door panel.

Specifically, the service tool kit of the present invention includes one or more of:

punch assembly;
bit assembly;
lubricant;
lubricant sprayer with a directional tube;
striker; and
plug.

In order to use the service toolkit, the user must also have a drill, or driver, and a means for tightening the bit assembly into the drill such as a chuck key or hex key.

The method of use of the present invention involves opening the automobile door with the automatic window that is to be serviced.

In the first step, a central point on the end of the door is selected for making a small hole. The user makes a mark at the starting point. It is anticipated that often the starting point will be at the bottom corner of the door. This is where the user will place a center point door.

In a second step, the user assembles the punch assembly (if it is not already assembled).

In a third step, at the selected point, the punch is lined up with the mark created in the first step and placed with the point against the door. Using the striker or striker tool, the user strikes the opposite end of the punch which leaves a dimple in the metal of the doorframe. The depth of the dimple is limited by the stop pad collar and punch pad attached to the assembled punch assembly.

In a fourth step, the user assembles the bit assembly (if it is not already assembled), and attaches the bit assembly to the drill.

In a fifth step, the user places the point of the bit assembly in the dimple so that the bit assembly will not move around on the metal when the drill is activated. The user drills a hole in the side wall of the door. The depth of the whole is set by the drill bit stop collar and bit pad attached to the assembled bit assembly. The drill bit stop collar allows the hole to be drilled without going too far into the door such that the spinning but my damage internal parts in the door.

In a sixth step, the user obtains a spray can of lubricant with a directional tube. It is anticipated that the lubricant will be white lithium spray grease, but other lubricants may also be used. Because it is desirable to have the lubricant be applied to the parts of the automatic window, certain lubricants are anticipated to work better than others. It is desirable that the lubricant may be applied to the motors, regulator, inch cables, rails, guide rails, gears, glass run channels, sliding track rails, and glass molding. It may also be desirable that the lubricant be applied to the interior door handles, door lock actuators, lock cylinders, ignition lock cylinders, and door lock latches. To this end, it is anticipated that the lubricant be atomized and be propelled by aerosol or other propellant. It is also advisable that the lubricant be sprayed into the automobile door interior in a fog or spray that tends to fill the interior of the door. In this manner, the lubricant will contact all of the interior parts of the door including the automatic window parts. Although not the only lubricant usable, it is anticipated that white lithium grease has characteristics consistent with the intent of the present invention. The directional tube of the lubricant spray can is inserted into the hole that was drilled into the door frame. Lubricant is then sprayed into the interior of the door, while moving the can or tip of the directional tube in order to spray and multiple directions inside the door, thus lubricating the internal parts of the door including the automatic window assembly parts. After lubrication is applied, the spray can and directional tube are removed.

In a seventh step, a plug is inserted into the drilled hole in the doorframe.

The process can be repeated for each door that has a power window. If done correctly the door latch, the glass carriers, the linkages, the inner and outer door handles, the lock and ignition cylinders, regulators and motors, and the door lock actuators will all be lubricated.

Additionally, it is advantageous to clean and lubricate the window crevices, the door handle, the hatchback, the door hinge, the keyhole, the hood latch, and the door latch.

DETAILED DESCRIPTION OF THE PREFERRED EMBODIMENT

Figure 1:
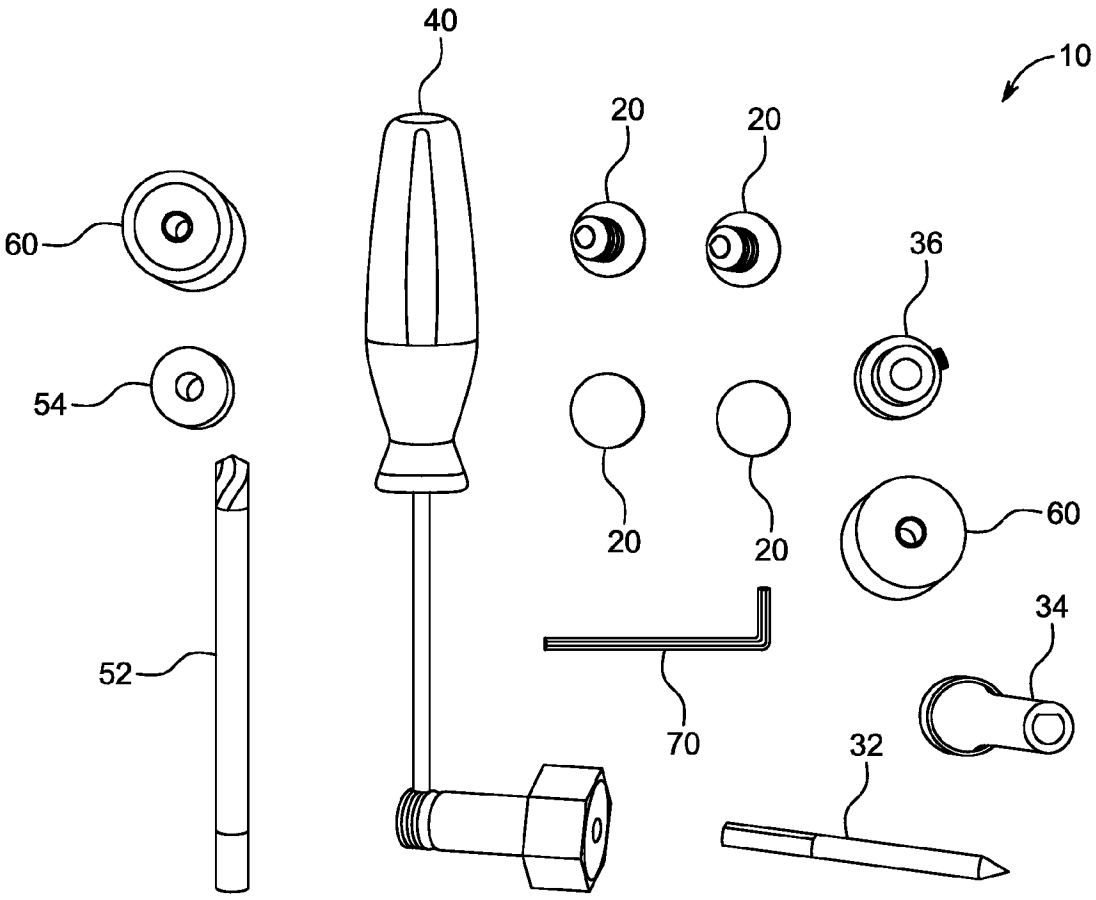
FIG. 1 is a perspective view of the components of the present invention.

Referring to the figures, FIG. 1 is a perspective view of the components of the present invention. The service tool kit 10 of the present invention may include one or more of: a punch assembly 30, a bit assembly 50, lubricant (not shown), a lubricant sprayer with a directional tube (not shown), a striker 40, a plug (20), and a hex key (or Allen wrench) 70. The punch assembly 30 is made up of a punch 32, a punch handle 34, a punch stop collar 36, and a stop pad 60. The bit assembly 50 is made up of a drill bit 52, a bit stop collar 54, and a stop pad 60.

Figure 2:
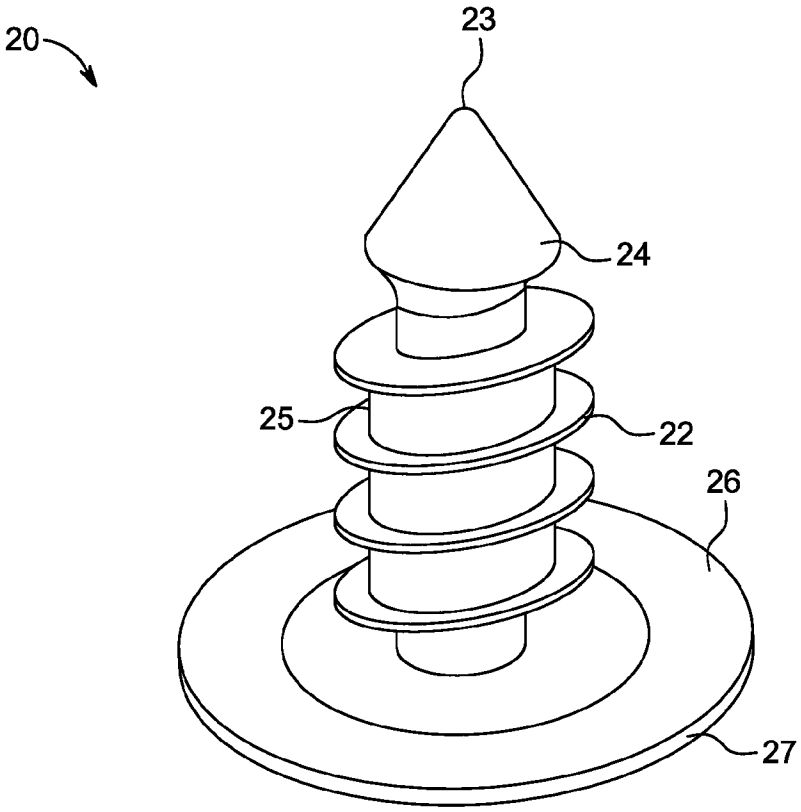
FIG. 2 is a perspective view of the plug.

FIG. 2 is a perspective view of the plug 20. The plug 20 can also be a part of the kit 10. The plug 20 is sized in order to fit into the access hole created by the bit assembly 50. The plug 20 is manufactured to have retention capability such that when it is inserted into the access hole it will not exit the hole without external force being applied. As shown in the figure, one means of retention capability is accomplished with retention "wings" 22 that are angled so that it is relatively easy to insert the plug 20 into the hole, but once inserted the wings 22 hold the plug 20 in the hole. The plug 20 has an insertion point 23 at a first end 24 with retention means along a shaft 25. At the second end 26 is a larger diameter cap 27. The insertion point 23 of the first end 24 and the shaft 25 are sized to fit in the access hole. The retention means 22, such as the wings or sidebars, are sized larger than the access hole. The wings 22 are slightly flexible and tend to flex in one direction so that the insertion point 23 and shaft 25 of the plug 20 can be pushed into the access hole with the wings 42 flexing to allow their movement through the hole until the cap 27 is urged against the metal of the door. The diameter of the cap 27 is larger than the diameter of the access hole so that the cap 27 covers the hole. The wings 22 resist flexing to allow the removal of the plug 20, thus tending to keep the plug 20 in place in the access hole. The inserted plug 20 helps keep water and debris from entering the interior of the door through the access hole. Additionally, the plug 20 helps give the project they finished look rather than leaving a hole visible in the end of the door. Finally, the plug 20 can be removed by a user who wants to service the automatic window again at a later date. In an anticipated embodiment, the plug 20 is used with an approximately ¼" (6.4 mm) diameter hole. The stem or shaft 25 of the plug 20 in this embodiment would have a diameter of approximately 13⁄16" and the head or cap 27 of the plug 20 would be approximately 0.095"-0.540" in diameter. It is anticipated that the plug 20 would generally be manufactured from plastic, or nylon, or other similar synthetic materials.

Figure 3:
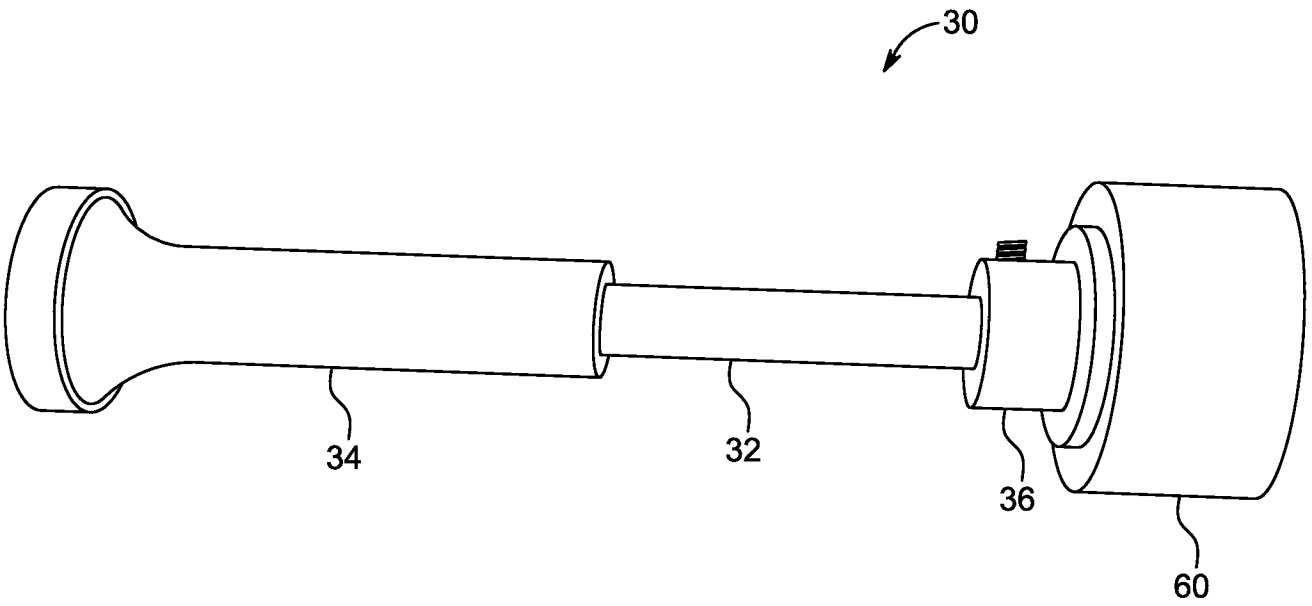
FIG. 3 is a perspective view of the punch assembly.

FIG. 3 is a perspective view of the punch assembly 30. The punch assembly 30 is used to mark the point at which the user wants to drill the access hole. The point 53 of a drill bit 52, when the drill is activated, has the tendency to move around, or skip, on surface of metal if it does not start in a recess. The punch assembly 30 forms a large enough dimple to help guide the tip 53 of the drill bit 52 and keep it in place until the drill bit 52 bites into the metal at which time the bit 52 will generally stay in place.

Figure 4:
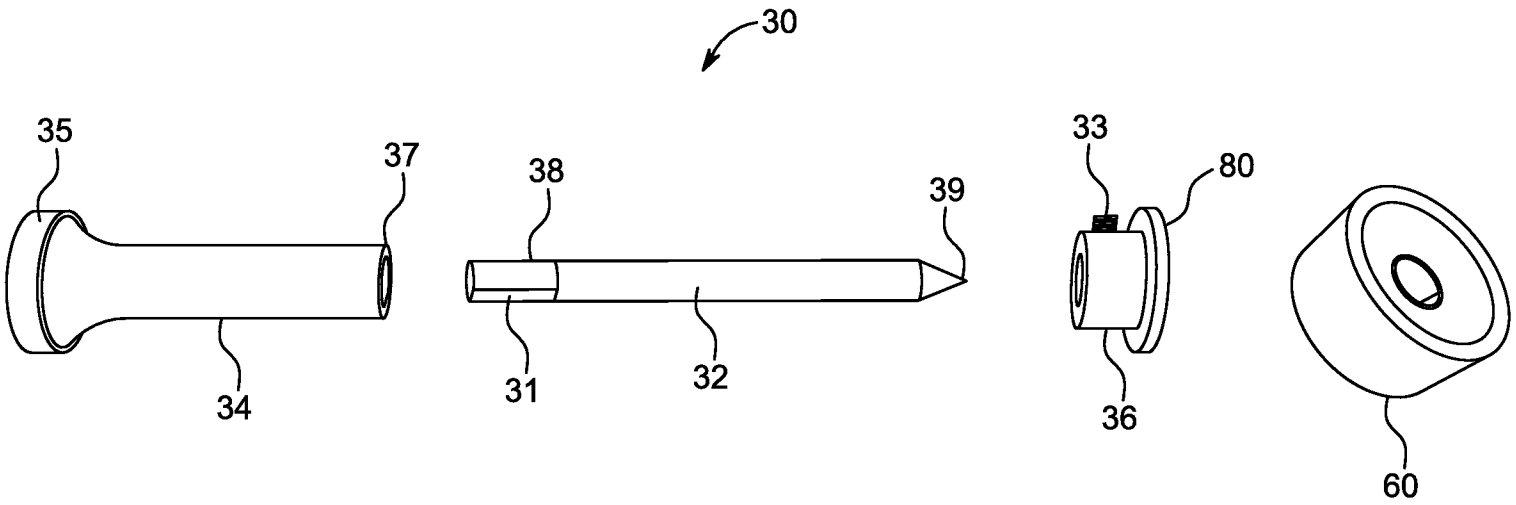
FIG. 4 is an exploded, perspective view of the punch assembly.

FIG. 4 is an exploded, perspective view of the punch assembly 30. The punch assembly 30 has a punch handle 34 with a first, striking end 35 designed to be hit by the striker 40 or other type of hammer. As shown in the figure, a portion of the first end 35 of the punch handle 34 may be thicker than the remainder of the handle 34 aiding in the user holding the punch assembly 30 while striking it and to provide a larger striking surface. The second end, or receiver, 37 of the punch handle 34 is designed to connect with the punch 32. It is generally anticipated that the receiver 37 will have an aperture sized to receive the second end 38 of the punch 32. However, there are many ways that the punch handle 34 and punch 32 can be connected. Including, it is anticipated that the punch handle 34 and punch 32 may be a single component. The punch 32 has a first end with a point 39 opposite the second end 38. If the connection means of the punch handle 34 and punch 32 is an aperture in the receiver 37, then the second end 38 may have a flattened portion 31 along a portion of the length of the punch 32. The flattened portion 31 allows air to escape when the punch 32 is inserted into the handle 34. The second end 37 of the punch handle 34 may end in a punch point 39, however as shown in the figure the punch 32 and punch point 39 can be a separate piece that is urged into, screwed into, or otherwise engaged with the second end 37 of the punch handle 34. If a separate punch 32 is used then upon multiple uses when the punch point 39 becomes dull, a new punch 32 with a sharper punch point 39 can be employed with the old handle 34.

A punch stop collar 36 has an aperture through which the punch 32 is inserted. The stop collar 36 slides along the length of the punch 32. The stop collar 36 employs a set screw 33 that can be urged against the punch 32 in order to maintain the stop collar 36 at a specific position along the length of the punch 32. The stop collar 36 has a shoulder 80.

The punch assembly 30 also incorporates a stop pad 60. It is generally anticipated that the stop pad 60 will be made from a rubber or rubberlike material. This is so it is less likely to damage or scratch the metal and paint of the automobile door when the punch assembly 30 is employed. The stop pad 60 has an aperture through which the point 39 is inserted. The stop pad 60 is urged against the stop collar shoulder 80. The stop pad 60 insures that when the user strikes the first or striking end 35 of the punch handle 34 that the punch point 39 will only enter the metal of the door a set distance. This ensures that the punch point 39 will not be driven through the metal sheet of the door and into the interior of the door where it could damage door parts or components. The stop pad 60 is generally cylindrical with a larger aperture at one end and a smaller aperture at the opposite end. The smaller aperture creates a ring that can be urged against the stop shoulder at the second and of the punch handle.

Figure 5:
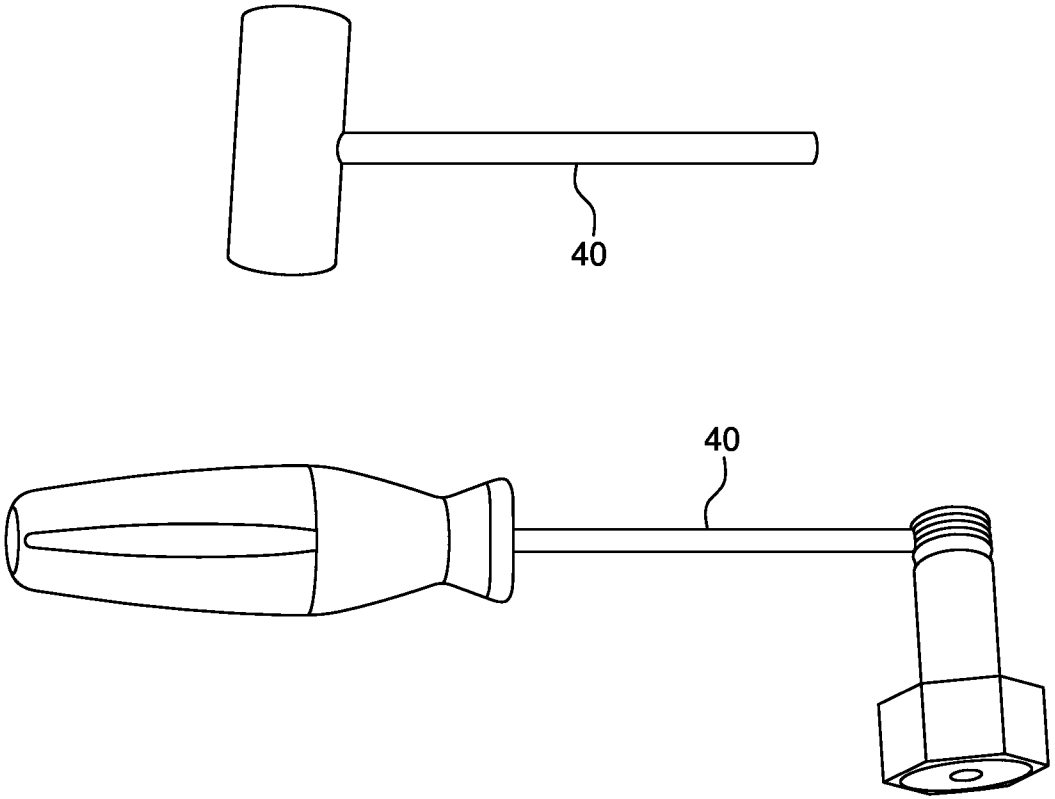
FIG. 5 is a perspective view of the striker.

FIG. 5 is a perspective view of two embodiments of a striker 40. While it is anticipated that virtually any hammer could be used with the kit, in a first embodiment of the kit a plastic or light synthetic hammer is employed as the striker. It is anticipated that a relatively light hammer would be advisable in order that it be easy to use, effective at creating a dimple with the punch assembly, and be less likely to damage the door if the user accidentally hits the door instead with the striker. While not limiting, in a preferred embodiment the weight range of the striker would be between 1 ounce and 2½ ounces.

Figure 6:
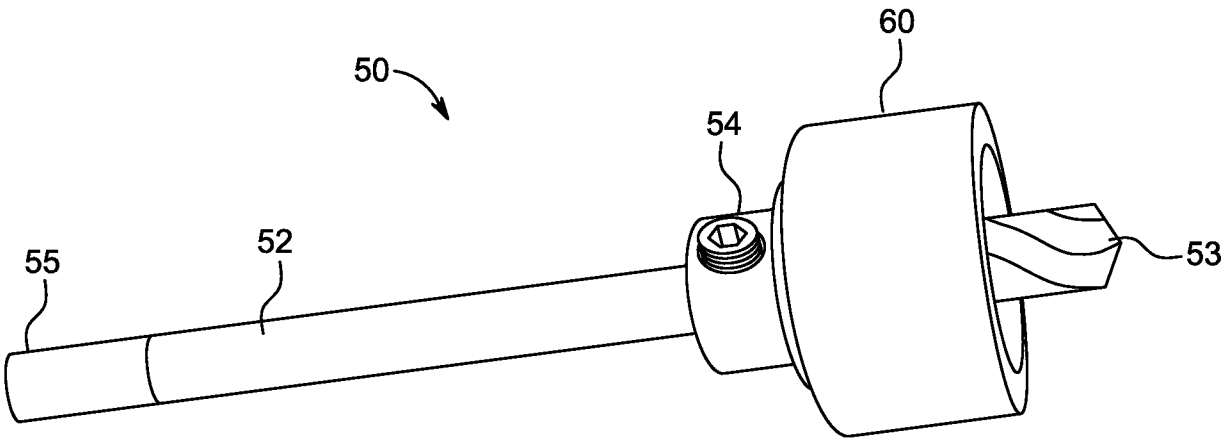
FIG. 6 is a perspective view of the bit assembly.

FIG. 6 is a perspective view of the bit assembly 50. The bit assembly 50 is used to drill an appropriately sized access hole into the interior of the automobile door. The access hole should be large enough to accept the directional tube used with the lubricant spray can.

Figure 7:
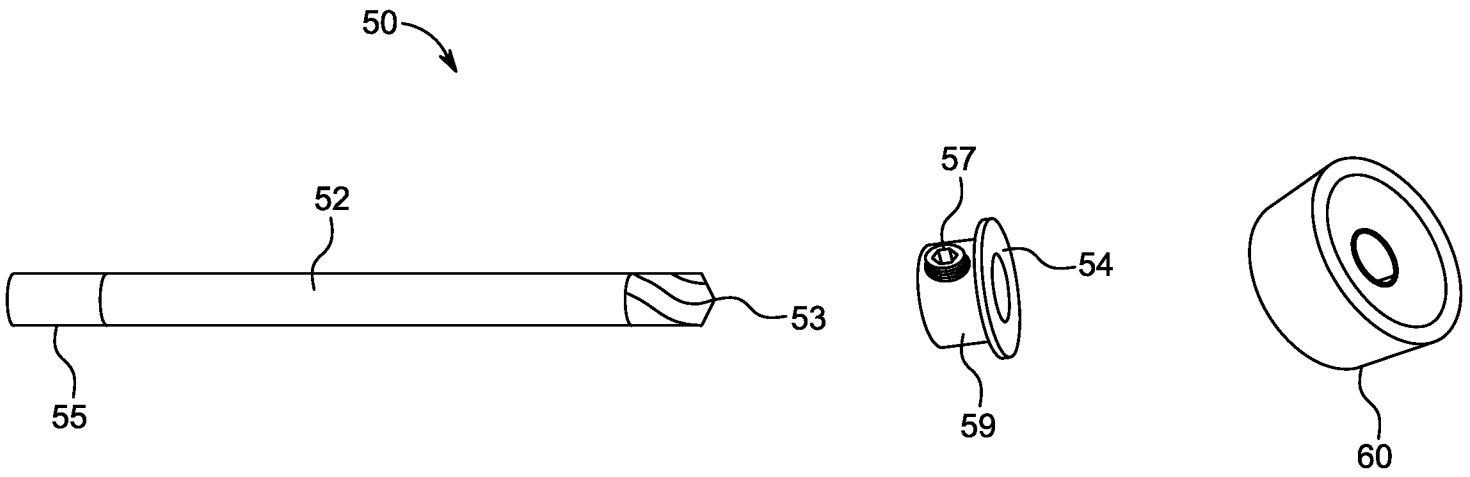
FIG. 7 is an exploded, perspective view of the bit assembly.

FIG. 7 is an exploded, perspective view of the bit assembly 50. The bit assembly 50 has a drill bit 52 as its core component. A stop collar 54 can be attached about the bit tip 53 leaving enough of the bit tip 53 exposed in order to drill through the sheet metal of the automobile door without extending into the interior of the door and possibly hitting and damaging other door components. The stop collar 54 will have an aperture through it sized to fit around the drill bit 52. The stop collar 54 may have a set screw 57 that can be urged against the side of the drill bit 52 and hold the stop collar 54 at a desired distance from the bit tip 53. If not a set screw 57, the stop collar 54 will have some other means to hold the stop collar 54 at the desired position. The bit assembly 50 also incorporates a stop pad 60. It is generally anticipated that the stop pad 60 will be made from a rubber or rubberlike material. This is so it is less likely to damage or scratch the metal and paint of the automobile door when the bit assembly 50 is employed. The stop pad 60 is urged against the stop collar 54 near the bit tip 53. The stop pad 60 insures that when the user activates the drill and drills through the sheet metal of the automobile door that the bit tip will only enter the metal of the door a set distance. This ensures that the bit tip 53 will not drive through the metal sheet of the door and into the interior of the door where it could damage door parts or components. The stop pad 60 is generally cylindrical in shape with a larger aperture at one end and a smaller aperture at the opposite end. The smaller aperture creates a ring that can be urged against the stop collar 54 on the drill bit 52. At the end of the drill bit 52 opposite the drill tip 53 is a connection shaft 55 that can be inserted into a bit receiver of a drill or driver. As is generally known, the drill bit tip 53 and shaft near the tip will have a twisted blade designed to cut into the metal sheet of the door creating an access hole through the door side. The drill bit 52 diameter will be sized in order to allow the lubricant can directional tube to fit through the created access hole. In the embodiment as described in FIG. 2, the diameter of the drill bit would be ¼", however other sizes are anticipated.

Figure 8B:
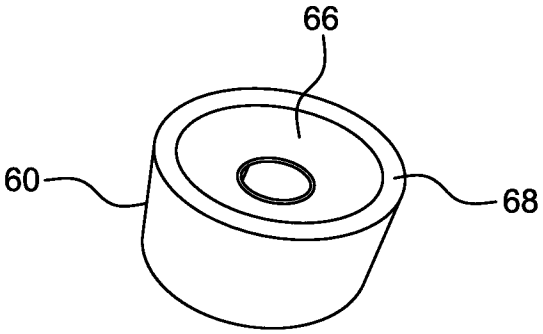
FIG. 8*b* is a perspective, tip-end view of a stop pad.
Figure 8A:
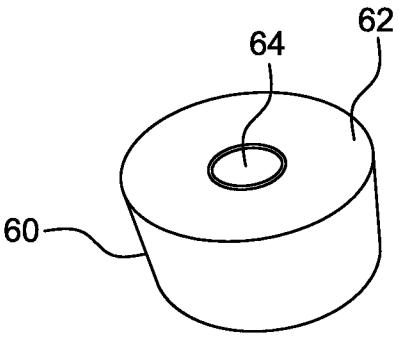
FIG. 8*a* is a perspective, shank-end view of a stop pad.

FIG. 8*a* is a perspective, shank-end view of a stop pad 60, while FIG. 8*b* is a perspective, tip-end view of a stop pad 60. As is shown, the shank end 62 of the stop pad 60 is anticipated to be generally flat with an aperture 64 sized to snugly fit around the drill bit 52 or punch 32. The generally flat surface of the shank end 62 of the stop pad 60 is intended to be urged against the shoulders of the stop collar's 36 and 54. The tip end 66 of the stop and 60 may have a rim 68 that comes to rest against the metal of the door when the punch assembly 30 or bit assembly 50 are used.

Figure 9:
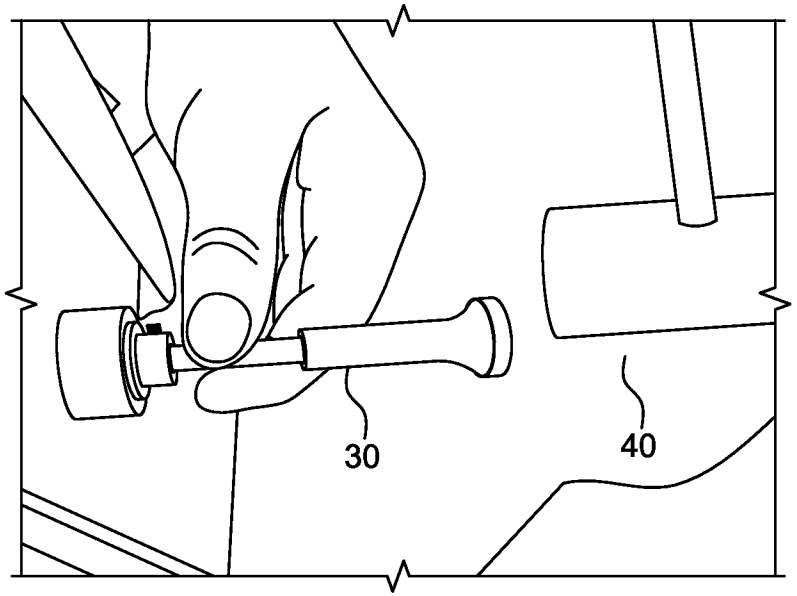
FIG. 9 is a perspective view of the striker being used with the punch assembly.

FIG. 9 is a perspective view of the striker 40 being used with the punch assembly 30. As shown, the striker 40 is used to strike the striking end 35 of the punch assembly 30. The punch tip 39 is driven into the automobile door end only as far as the punch stop 60 will allow it.

Figure 10:
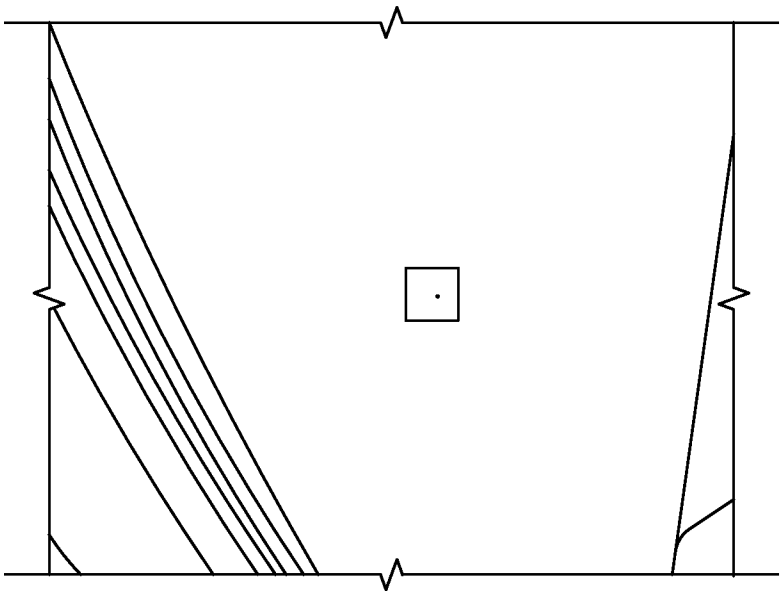
FIG. 10 is a perspective view of the dimple.

FIG. 10 is a perspective view of the dimple created using the striker 40 and punch assembly 30. The dimple is relatively small and along the end side of the automobile door. However, it is large enough to provide a guide to anchor the bit assembly 50 when it is used.

Figure 11:
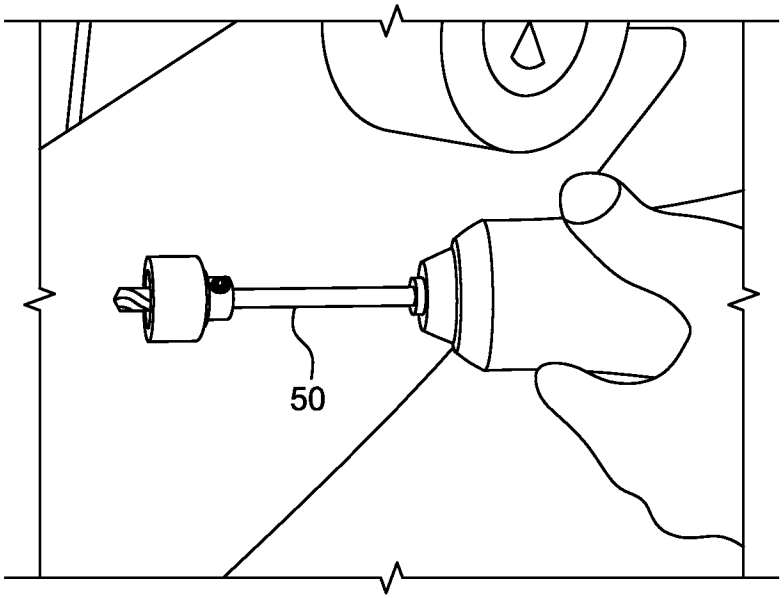
FIG. 11 is a perspective view of the bit assembly attached to a drill.

FIG. 11 is a perspective view of the bit assembly 50 attached to a drill. As is shown in this figure, the stop collar 54 is attached to the drill bit 52 with the stop pad 60 urged against the collar 59 and only a small length of the drill bit tip 53 extending beyond the stop pad 60.

Figure 12:
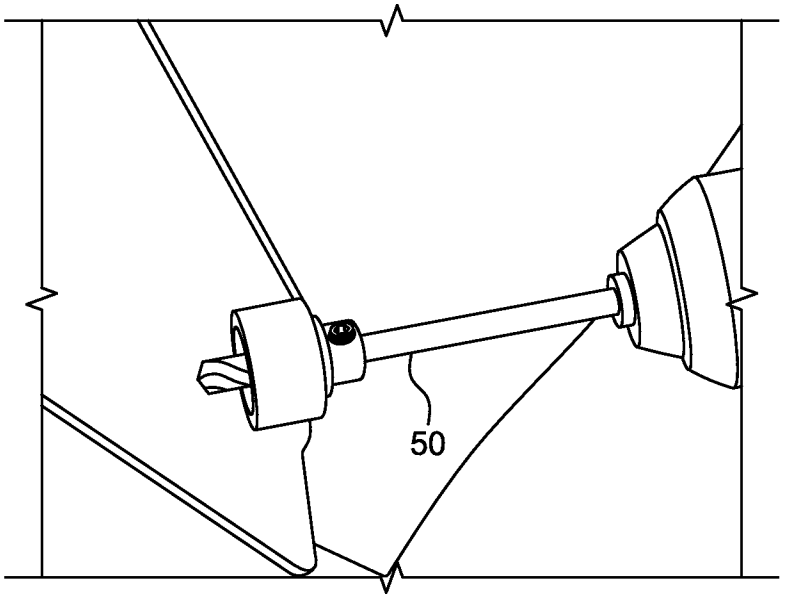
FIG. 12 is a perspective view of the bit assembly being used with a drill.

FIG. 12 is a perspective view of the bit assembly 50 being used with a drill. The drill bit tip 53 is placed in the dimple created using the striker 40 and punch assembly 30. As shown in this figure, the drill bit stop 60 will only allow the drill bit tip 53 to extend into the metal of the automobile door a preset length.

Figure 13:
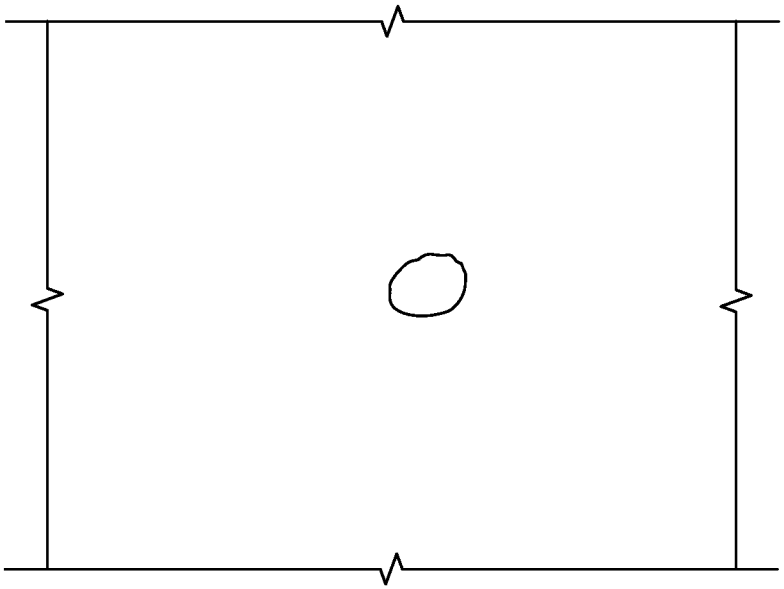
FIG. 13 is a perspective view of the access hole.

FIG. 13 is a perspective view of the access hole.

Figure 14:
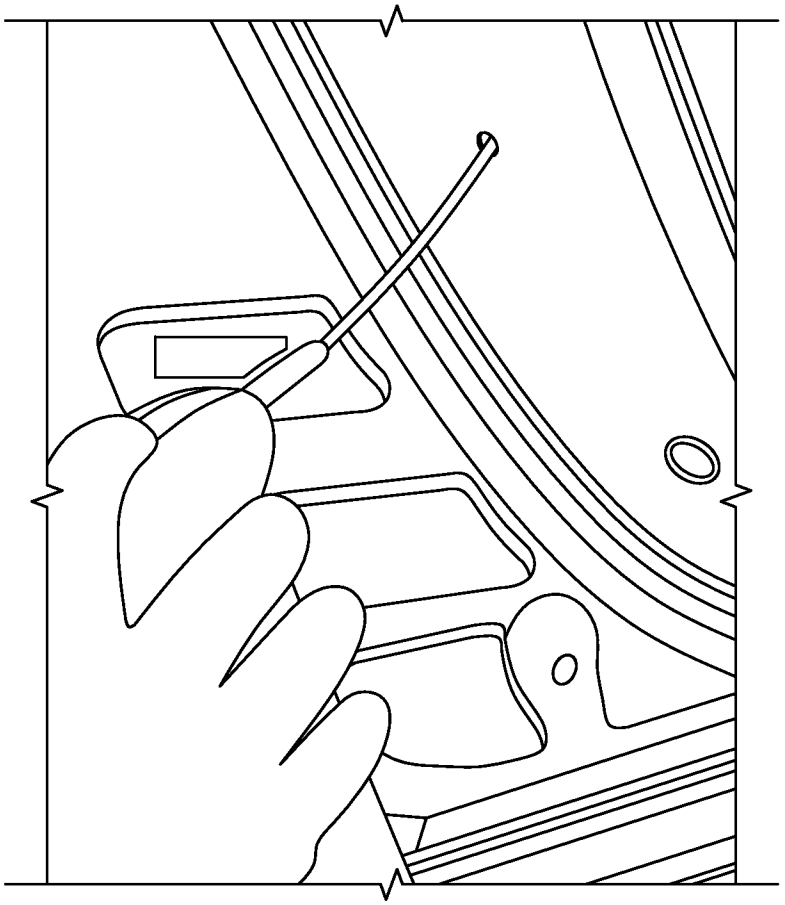
FIG. 14 is a perspective view of the lubricant can with the directional tube inserted into the access hole.

FIG. 14 is a perspective view of the lubricant can with the directional tube inserted into the access hole. The spray can is used to propel lubricant through the directional tube into the interior of the automobile door. It is anticipated that the directional tube will be flexible thus allowing the user to direct the lubricant into all areas of the door interior.

Figure 15:
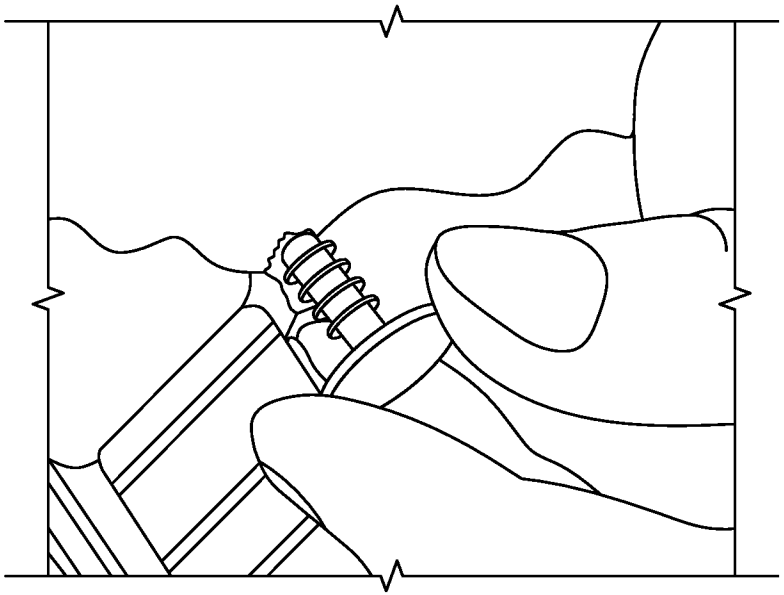
FIG. 15 is a perspective view of the plug being inserted into the access hole.

FIG. 15 is a perspective view of the plug 20 being inserted into the access hole. Once the lubricant is delivered, the directional tube can be removed and the plug 20 inserted. As described, the wings 22 or other retention means 22 tend to prevent accidental removal of the plug 20 after it is urged against the door.

Figure 16:
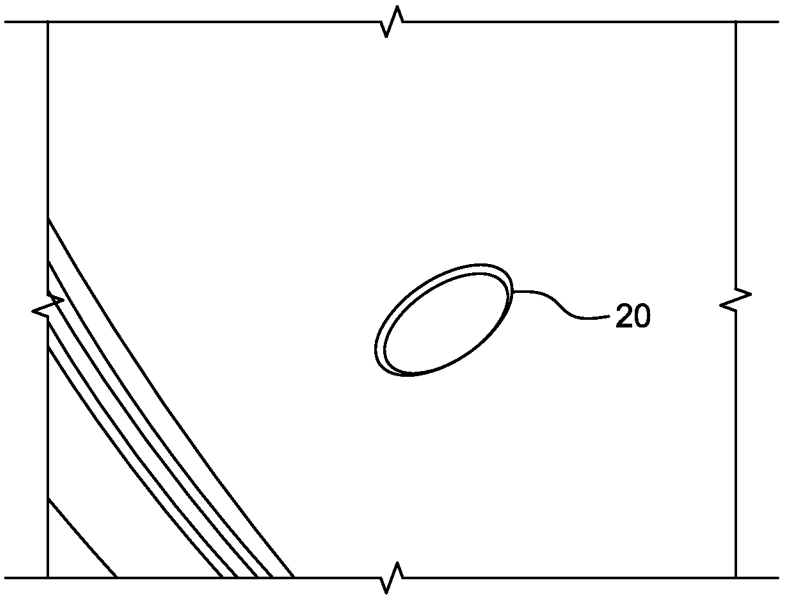
FIG. 16 is a perspective view of the plug inserted into the access hole.

FIG. 16 is a perspective view of the plug 20 inserted into the access hole. The engaged plug 20 is relatively inconspicuous and does not interfere with the door operation. However, it does restrict access to the interior of the door to moisture, dirt, and other debris. A user can remove the plug 20 for further servicing at a later time.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A kit for servicing and lubricating parts of an automatic window opener of an automobile that are inside the door frame without removing the door panel, the kit comprising:
- a punch assembly;
- a bit assembly;
- a lubricant;
- a lubricant sprayer; and
- a directional tube.

2. A kit for servicing and lubricating parts of an automatic window opener of an automobile that are inside the door frame without removing the door panel, the kit comprising:
- a punch assembly;
- a bit assembly;
- a striker; and
- a plug.

3. The kit of claim 2 further comprising:
- a lubricant;
- a lubricant sprayer; and
- a directional tube.

4. A method for using a kit for servicing and lubricating parts of an automatic window opener of an automobile that are inside the door frame without removing the door panel, the method comprising:
- selecting a point on the end of the automobile door;
- placing a punch assembly point against the selected point of the door;
- hitting a striking end of the punch assembly creating a dimple;
- placing a point of the bit assembly in the dimple;
- drilling an access hole in the door at the selected point;
- inserting a directional tube of a lubricant sprayer into the access hole;
- spraying lubricant into an interior of the door;
- removing the spray can and directional tube from the access hole; and
- inserting a plug into the access hole.

5. A method for using a kit for servicing and lubricating parts of an automatic window opener of an automobile that are inside the door frame without removing the door panel, the method comprising:
- providing a kit comprising a punch assembly, a bit assembly, a striker, a plug, a lubricant, a lubricant sprayer, and a directional tube;
- selecting a point on the end of the automobile door;
- placing a punch assembly point against the selected point of the door;

hitting a striking end of the punch assembly creating a dimple;

placing a point of the bit assembly in the dimple;

drilling an access hole in the door at the selected point;

inserting a directional tube of a lubricant sprayer into the access hole;

spraying lubricant into an interior of the door;

removing the spray can and directional tube from the access hole; and inserting a plug into the access hole.

6. A kit for lubricating an automatic window opener located within an automobile door without removing a door panel, the kit comprising:

a punch;

a punch handle;

a punch stop collar;

a punch stop pad;

a drill bit;

a bit stop collar; and a bit stop pad.

7. The kit of claim 6, further comprising:

a lubricant;

a lubricant sprayer; and a directional tube.

8. The kit of claim 6, further comprising:

a striker; and a plug adapted to engage in a hole drilled by said drill bit.

9. The kit of claim 8, further comprising:

a lubricant;

a lubricant sprayer; and a directional tube.

10. The kit of claim 9, wherein said lubricant is white lithium grease.

11. The kit of claim 8, wherein said striker is between 1 ounce and 2½ ounces.

12. A kit for lubricating an automatic window opener located within an automobile door without removing a door panel, the kit comprising:

a punch;

a punch handle attachable to said punch;

a punch stop collar, wherein said stop collar is made from a rigid material;

a punch stop pad, wherein said punch stop pad is made from a flexible material;

a drill bit;

a bit stop collar;

a bit stop pad, wherein said bit stop pad is made from a flexible material;

wherein said bit stop collar is engaged about said bit and said bit stop pad is engage about said bit and urged against said bit stop collar; and wherein said bit stop pad is attached about said bit leaving enough of said bit exposed to drill through said automobile door without said bit extending into an interior of said door.

13. The kit of claim 12, further comprising:

a lubricant;

a lubricant sprayer; and a directional tube.

14. The kit of claim 12, further comprising:

a striker; and a plug adapted to engage in a hole drilled by said drill bit.

15. The kit of claim 14, further comprising:

a lubricant;

a lubricant sprayer; and a directional tube.

16. The kit of claim 15, wherein said lubricant is white lithium grease.

17. The kit of claim 14, wherein said striker is between 1 ounce and 2½ ounces.

18. A kit for lubricating an automatic window opener located within an automobile door without removing a door panel, the kit comprising:

a punch;

a punch handle;

a punch stop collar;

a punch stop pad;

a drill bit;

a bit stop collar;

a bit stop pad; and a plug, adapted to engage in a hole drilled by said drill bit.

19. The kit of claim 18, further comprising:

a lubricant;

a lubricant sprayer; and a directional tube.

20. The kit of claim 18, further comprising a striker.

21. The kit of claim 20, further comprising:

a lubricant;

a lubricant sprayer; and a directional tube.

22. The kit of claim 21, wherein said lubricant is white lithium grease.

23. The kit of claim 20, wherein said striker is between 1 ounce and 2½ ounces.

* * * * *